United States Patent [19]

Woods

[11] 4,430,169

[45] Feb. 7, 1984

[54] METHOD OF PRODUCING GREEN COATINGS ON ALUMINUM AND ALUMINUM ALLOYS

[76] Inventor: Jack L. Woods, 1517 Ninth St., Ogden, Utah 84404

[21] Appl. No.: 354,528

[22] Filed: Mar. 4, 1982

[51] Int. Cl.[3] ..... C25D 11/22

[52] U.S. Cl. ..... 204/35 N; 204/42

[58] Field of Search ..... 204/35 N, 38 A, 42

[56] References Cited

U.S. PATENT DOCUMENTS

| | | | |
|---|---|---|---|
| 3,787,295 | 1/1974 | Endinger et al. | 204/35 N |
| 3,874,902 | 4/1975 | Andrus | 204/35 N X |
| 3,917,887 | 11/1975 | Stiller | 427/343 |
| 3,929,593 | 12/1975 | Sugiyama et al. | 204/35 N |
| 4,180,433 | 12/1979 | Darrow | 204/35 N |

*Primary Examiner*—G. L. Kaplan
*Assistant Examiner*—William Leader
*Attorney, Agent, or Firm*—Terry M. Crellin

[57] ABSTRACT

A method of producing corrosion resistant, lightfast green coating on aluminum or an aluminum alloy wherein an initial anodic coating is formed on the aluminum or aluminum alloy. The anodized item is then placed in an electrolyte containing silver or silver and copper ions, and the metal ions or compounds thereof are electrolytically desposited into the pores of the anodic film which imparts a yellow color resembling gold to the anodic film. The colored anodic film is then dyed with a light fast blue organic dye. The resulting green colored coating is lightfast and corrosion resistant.

10 Claims, No Drawings

METHOD OF PRODUCING GREEN COATINGS ON ALUMINUM AND ALUMINUM ALLOYS

BACKGROUND OF THE INVENTION

1. Field

The invention pertains to a process for imparting a lightfast, corrosion resistant coating to aluminum or aluminum alloy.

2. State of the Art

Many attempts have been made in the past to produce a lightfast green coating on anodized aluminum or aluminum alloys by use of organic dyes, inorganic pigments, and other means. Each of the prior art methods has had its drawbacks. Organic coatings which have been used eventually chalk or blister. Green organic dyes which have been used for at least thirty (30) years to dye anodic films, all have very poor lightfastness and none are suitable for long term outdoor weathering for such things as signs and buildings. The green dyes are only suitable for novelty items and products which need not be colorfast.

Attempts have also been made to use electrolytic means to produce colors on aluminum and aluminum alloys. U.S. Pat. No. 3,616,309 discloses a process using an electrolyte containing sodium tellurite. The color produced, however, is weak and of a pale light yellow-green shade having no commercial value for signs or architectural purposes. A closely related process using an electrolyte containing tellurium is disclosed in U.S. Pat. No. 3,616,308, and the results are about the same as those achieved using the process of the previously cited patent. Another process for coloring anodic coatings on aluminum and aluminum alloys is disclosed in U.S. Pat. No. 3,661,729 wherein the aluminum or an alloy thereof is first subjected to anodic oxidation using an electric current comprising both a direct and alternating current component. The resulting oxide coating is then dipped in an aqueous solution of metallic cations or anions in the absence of any electric current. A very poor yellow-green and a light pea green color is produced erratically by this process. The colors so obtained are not suitable for road signs or other architectural purposes.

OBJECTIVES

A principal objective of the present invention is to provide a process for imparting a green color, which approximates the color of road signs (interstate and street, etc.) to an anodic coating on aluminum and aluminum alloys, wherein the resulting green colored coating is extremely lightfast and corrosion resistant. Another object of the invention is to provide a green colored anodic coating on aluminum and aluminum alloys which has an appearance and quality to be suitable for architectural purposes.

SUMMARY OF THE INVENTION

The above objectives are achieved in accordance with this invention by a process in which an anodic film is formed on the aluminum or aluminum alloy, the anodic film is electrolytically treated to impart a yellow color to the film, and the colored film is then dyed with a lightfast blue dye to produce a lightfast, corrosion resistant, green colored anodic film on the aluminum or aluminum alloy. The complete procedure for producing a long life, corrosion resistant, green colored anodic coating on an aluminum or aluminum alloy item begins with the proper surface preparation of the item, i.e., formation of the anodic film. Those skilled in the art of anodizing are familiar with the techniques required to assure a sound anodic film, and the details of those techniques need not be elaborated upon in this disclosure. Those less skilled in the art are referred to the "Metal Finishing Guide Book and Directory" published by Metals and Plastics Publications; Hackensack, New Jersey. Sulfuric acid anodizing baths or combined sulfuric acid-oxalic acid baths which are well known in the art are entirely suitable for producing anodic films within the scope of this invention. Anodizing baths such as disclosed in U.S. Pat. No. 3,524,799 are also suitable for use in the present invention. In fact, any anodizing system capable of producing a colorless anodic film or an essentially colorless film of thickness between 10 and 35 microns is suitable as a base for the unique green colored coating of this invention.

Subsequent to formation of the anodic film, excess electrolyte is removed from the anodic films by rinsing in clean water at room temperature. The unsealed, anodized item is then submerged in an electrolyte containing silver or silver and copper cations. A counter electrode of graphite or other inert material is also submerged in the electrolyte and an alternating current is applied between the anodized item and the counter electrode which causes metal values comprising silver or a combination of silver and copper values to be deposited within the anodic film at the base of the pores therein. As a result of the deposition of the metal values, the anodic film becomes colored from straw-yellow to deep gold, depending on the length of time that the alternating current is applied between the anodized item and the counter electrode. The term "metal values" as used herein is meant to be inclusive of silver and copper complexes and compounds as well as for metallic silver and copper. Little is known of the actual nature of the deposits which result from the application of the alternating current, and it is not intended that the invention be limited to or by the actual nature of the deposited metal values.

Following the deposition of the metal values within the anodic film, the item is removed from the electrolyte and rinsed in clear water at room temperatures. The rinsed item is then immersed in a dye bath containing a blue or turquoise organic dye of proven lightfastness. The organic dye is adsorbed by the anodic film. The anodic film is rendered green in color as a result of combining the inorganic yellow to gold color produced electrolytically with the blue or turquoise color of the organic dye. The item is sealed, after water rinsing, in a nickel acetate solution as is well known by those familiar with the art of anodizing. The resulting green colored item is both lightfast and corrosion resisting.

DETAILED DESCRIPTION

As mentioned previously, the first step in producing the novel, corrosion resistant, lightfast, green coating of the present invention involves forming an anodic film on the aluminum or aluminum alloy. The anodic film can be formed by numerous methods well known in the art which produce a colorless or essentially colorless anodic film. The method most widely used employs sulfuric acid in water at concentrations of from about 12% to 25% by weight. The temperature of the anodizing bath is typically about room temperature, i.e., from about 60° to 90° F., preferably about 70° to 75° F. Current densities of about 10 to 30 amps per square foot can be used with voltages in the range of about 12 to 24 volts. Glycerol and glycolic acid can be added to the sulfuric acid anodizing bath as is well known in the art. For example, the anodizing electrolyte may comprise from about 100 to 250 grams per liter of sulfuric acid, about 0 to 5 milliliters per liter of glycerol, and from about 0 to 10 milliliters per liter of a 70 % aqueous glycolic acid solution. Another anodizing electrolyte which is known in the art and can be used in practicing the present invention comprises 100 to 250 grams per liter of sulfuric acid and from about 0 to 10 grams per liter of oxalic acid.

Following the formation of the anodic film on the aluminum or aluminum alloy item, it is removed from the anodizing bath and preferably rinsed in clean water. It should be noted that the water rinse is not absolutely required, especially when a sulfuric acid anodizing bath was used inasmuch as the succeeding step of the process of this invention involves submerging the anodized item into an aqueous sulfuric acid solution. The water rinse, however, does minimize carrying possible contaminants from the anodizing bath to the succeeding bath. The temperature of the water rinse is not critical, with room temperature being economically advantageous.

As mentioned above, the anodized item is submerged in an aqueous coloring electrolyte containing sulfuric acid and silver cations or a combination of silver and copper cations. The coloring electrolyte preferably contains from about 0.2 to 0.4 grams per liter of silver sulfate and sulfuric acid sufficient to produce a pH of between about 1.0 and 1.4. In addition, the coloring electrolyte can also contain from about 10 to 20 grams per liter of copper sulfate and/or about 3 to 10 grams per liter of aluminum sulfate.

A counter electrode of an inert material such as graphite is also immersed in the coloring electrolyte and a source of alternating current voltage (advantageously 50 to 60 cycles) is connected to the anodized item and the counter electrode in the coloring electrolyte to provide a current density of between about 0.2 and 0.4 amps per square decimeter with respect to the anodized item. The temperature of the coloring electrolyte is maintained between about 14° C. and 25° C. The anodized item is left in the coloring bath with the alternating current on for a length of time to impart a yellow to gold color to the anodic film on the anodized item, generally from about 1 or 1.5 minutes to 5 minutes.

The colored, anodized item is removed from the coloring electrolyte and preferably given a thorough rinsing in clean water to prevent carryover of possible contaminants from the coloring electrolyte to the next step in the process which is immersing the item in a dye bath containing a proven lightfast blue or turquoise dye. The temperature of the water rinse is not critical, with room temperature being economically advantageous.

Two dyes of proven lightfastness which have been found useful in the present process are phthalocyanine acid blue #243 and anthraquinone acid blue #43 which are manufactured by Sandoz Chemicals and Colors, East Hanover, N.J. and E. I. DuPont de Nemours, Inc., Wilmington, Del. The dye baths are operated under conditions suggested by the manufacturer of the dye which is being used. The blue dye converts the yellow to gold color of the anodic film on the anodized item to a colorfast green color.

Following dying of the anodic film, the anodized item is rinsed in clean water to remove excess dye, and the anodized item is sealed in accordance with procedures well known in the anodizing art. The temperature of the rinsing is again not critical, with room temperature being economically advantageous. The sealing of the green colored anodized items can be done in hot water or by a steam treatment in accordance with standard practices in the anodizing art. Preferably, however, the green colored anodized items are sealed in a water solution of nickel acetate in accordance with standard practices in the anodizing art.

The following examples are given to further illustrate the practice of what is presently contemplated as the best mode of carrying out the invention.

EXAMPLE 1

A 6063 alloy aluminum extrusion was anodized to a film thickness of 20 microns using an anodizing bath comprising 200 grams per liter of sulfuric acid. The current density employed was 12 amps per square foot, and the temperature was maintained at 72° F. The anodized extrusion was rinsed in clean water at room temperature, and the extrusion was then immersed in an aqueous coloring electrolyte bath comprising 0.3 grams per liter of silver sulfate, 15 grams per liter of copper sulfate, 5 grams per liter of aluminum sulfate, and sufficient sulfuric acid to give the electrolyte a pH of 1.2. Alternating current (60 cycle) was passed through the immersed extrusion at a current density of 0.3 amp per square decimeter for 2 minutes.

The extrusion was then removed from the coloring electrolyte and rinsed in clean water at room temperature. The extrusion had a yellow-gold color of uniform consistency. The yellow colored extrusion was then immersed in an aqueous dye bath comprising 12 grams per liter of a turquoise dye marketed under the tradename Sandoz Turquoise PLW dye. The temperature of the dye bath was maintained at 60° C. and the extrusion was left in the dye bath for 20 minutes. The extrusion was then rinsed in clean water at room temperature and sealed in a water solution of nickel acetate.

The resulting extrusion had a uniform green color closely approximating the green color used on U.S. Interstate Highway signs. Weather and Fadeometer testing for lengths of time up to 2000 hours confirmed that the green, anodized film was indeed lightfast and resistant to corrosion.

EXAMPLE 2

The test procedures of Example 1 were repeated using another 6063 alloy aluminum extrusion, with the only difference in the experimental procedure being that the dye used in the dye bath was a phthalocyanine acid blue number 243 manufactured by E. I. DuPont de Nemours, Inc. The results of the weather and Fadeometer testing were identical with those reported in Example 1.

EXAMPLE 3

The test procedures of Example 1 were repeated except that a 7075 alloy aluminum extrusion was used; the anodizing bath was an aqueous solution comprising 200 grams per liter of sulfuric acid, 2 milliliters per liter of glycerol, 3 milliliters per liter of 70% glycolic acid; the current density in the anodizing step was maintained at 24 amps per square foot, with the temperature of the bath being maintained at 70° F.; and the thickness of the anodic film which was produced was 18 microns. The results, including the weather and Fadeometer testing, were identical with those reported in Example 1.

EXAMPLE 4

The test procedures of Example 1 were repeated using another 6063 alloy aluminum extrusion, with the only difference in the experimental procedure being that the coloring electrolyte bath was an aqueous solution comprising 0.3 grams per liter of silver sulfate, 5 grams per liter of aluminum sulfate, and sufficient sulfuric acid to give the electrolyte a pH of 1.2. The results, including the weather and Fadeometer testing, were identical with those reported in Example 1.

EXAMPLE 5

The test procedures of Example 1 were repeated using another 6063 alloy aluminum extrusion, with the only differences in the experimental procedure being that the anodizing bath was an aqueous solution comprising 175 grams per liter of sulfuric acid and 5 grams per liter of oxalic acid, and that the temperature of the anodizing bath was maintained at 74° F. The results, including the weather and Fadeometer testing, were identical with those reported in Example 1.

EXAMPLE 1

The test procedures of Example 1 were repeated using a 3003 alloy aluminum extrusion, with the only differences in the experimental procedure being that the current density in the coloring electrolyte bath was 0.2 amp per square decimeter, and the length of time current passed through the extrusion in the coloring electrolyte bath was 3.5 minutes. The results, including the weather and Fadeometer testing, were identical with those reported in Example 1.

Although several preferred embodiments of the process of the present invention have been described, it is to be understood that the present disclosure is made by way of example and that various other embodiments are possible without departing from the subject matter coming within the scope of the following claims, which subject matter is regarded as the invention.

I claim:

1. A process for producing a green colored coating on aluminum or aluminum alloys comprising the steps of:

anodizing the aluminum or aluminum alloy article to form an anodic coating thereon;

passing an alternating current between an electrode system comprising the previously anodized aluminum or aluminum alloy article and a counter electrode, while said electrode system is immersed in an aqueous, acidic bath comprising from about 0.2 to 0.4 grams per liter of a soluble silver salt, whereby the anodic coating on said anodized article is colored yellow; and immersing the yellow colored, anodized article in a dye bath containing a lightfast blue dye, whereby the yellow colored anodic coating on said anodized article is converted to a green color.

2. A process as claimed in claim 1, wherein said aqueous, acidic bath further includes a soluble salt.

3. A process as claimed in claim 1 wherein said aqueous, acidic bath comprises from about 0.2 to 0.4 grams per liter of silver sulfate and sufficient sulfuric acid to give said aqueous bath a pH of from about 1.0 to 1.4.

4. A process as claimed in claim 3, wherein said aqueous, acidic bath also contains about 10 to 20 grams per liter of copper sulfate.

5. A process as claimed in claim 4, wherein said aqueous, acidic bath also contains about 3 to 10 grams per liter of aluminum sulfate.

6. A process as claimed in claim 3, wherein said aqueous, acidic bath also contains about 3 to 10 grams per liter of aluminum sulfate.

7. A process as claimed in claim 3, wherein said aqueous acidic bath also contains about 10 to 20 grams per liter of copper sulfate and about 3 to 10 grams per liter of aluminum sulfate and further wherein the temperature of said aqueous, acidic bath is maintained at between about 14° C. and 25° C., and the current density of the current passing through said anodized article in the aqueous acidic bath is between about 0.2 and 0.4 amp per square decimeter.

8. A process as claimed in claim 3, wherein the anodizing of the aluminum or aluminum alloy is done in an anodizing electrolyte comprising from about 100 to 250 grams per liter of sulfuric acid and from about 0 to 10 grams per liter of oxalic acid.

9. A process as claimed in claim 3, wherein the anodizing of the aluminum or aluminum alloy is done in an anodizing electrolyte comprising from about 100 to 250 grams per liter of sulfuric acid, about 0 to 5 milliliters per liter of glycerol, and from about 0 to 10 milliliters per liter of a 70% aqueous glycolic acid solution.

10. A process as claimed in claim 1 wherein the lightfast blue dye is selected from the group consisting of phthalocyanine acid blue and anthraquinone acid blue dyes.

* * * * *